United States Patent [19]

Hilmer et al.

[11] Patent Number: 5,038,825

[45] Date of Patent: Aug. 13, 1991

[54] MULTIPORT VALVE

[75] Inventors: Günter Hilmer; Walter Kolb, both of Augsburg, Fed. Rep. of Germany

[73] Assignees: O & K Orenstein; Koppel Aktiengesellschaft, both of Dortmund, Fed. Rep. of Germany

[21] Appl. No.: 490,191

[22] Filed: Mar. 8, 1990

[30] Foreign Application Priority Data

Mar. 25, 1989 [DE] Fed. Rep. of Germany ..... 3909988

[51] Int. Cl.[5] ..... F15B 13/02

[52] U.S. Cl. ..... 137/625.6; 91/464; 137/625.66

[58] Field of Search ..... 91/464; 137/625.6, 625.66

[56] References Cited

U.S. PATENT DOCUMENTS 4,355,660 10/1982 Huffman ..... 137/625.66 X

FOREIGN PATENT DOCUMENTS 3508340 4/1987 Fed. Rep. of Germany .

*Primary Examiner*—Gerald A. Michalsky

*Attorney, Agent, or Firm*—Browdy and Neimark

[57] ABSTRACT

In a hydraulically operated multiport valve having a floating position for connecting the cylinder chambers of a hydraulic piston-cylinder drive, a valve slide and a restraining piston associated with it are provided. By means of a respective dimensioning of the surface of both the part of the valve slide which can be charged with control pressure for attaining the floating position and of the restraining piston, a displacement of the restraining piston against the maximum pressure present in its control chamber becomes possible.

2 Claims, 1 Drawing Sheet

MULTIPORT VALVE

BACKGROUND OF THE INVENTION (1) Field of the Invention

The invention relates to a multiport valve for control of the working pressure between a consumer and a working pressure source or tank.

(2) The Prior Art

In such a multiport valve, known from German Patent 35 08 340, a valve is disposed in the restraining piston which is opened by the valve slide when the latter is moved into a position corresponding to a floating position of the consumer by a corresponding charge with the maximum control pressure. A known multiport valve was improved by means of pressure relief in the control chamber of the restraining piston which was achieved by means of a switchable three-way valve located outside of the multiport valve. However, such valves are basically expensive and prone to trouble.

BRIEF DESCRIPTION OF THE INVENTION

It is therefore an object of the invention to simplify a multiport valve and to make it less prone to trouble.

The heart of the invention lies in the fact that it becomes possible, by a corresponding dimensioning of the surface of both the part which can be charged with control pressure for the floating position of the valve slide, which is in the form of a piston, and the restraining piston to cause a displacement of the restraining piston against the maximum control pressure in its control chamber. Thus the restraining piston no longer has a valve, but is completely closed over its entire cross section. Pressure relief no longer is provided in the control chamber; instead, the already provided pressure control valve of the entire control pressure system is used to carry off the control fluid displaced from the control chamber in the course of the displacement of the restraining piston from the stop position into a deflected position, while maintaining maximum control pressure. Further characteristics, details and advantages of the invention ensue from the following description of an exemplary embodiment by means of the drawing, which illustrates the part essential for the invention in a structural view and all other parts, not essential for the invention itself, but useful for the description, in a schematic manner.

DETAILED DESCRIPTION OF THE PREFERRED EMBODIMENT

Figure 1:
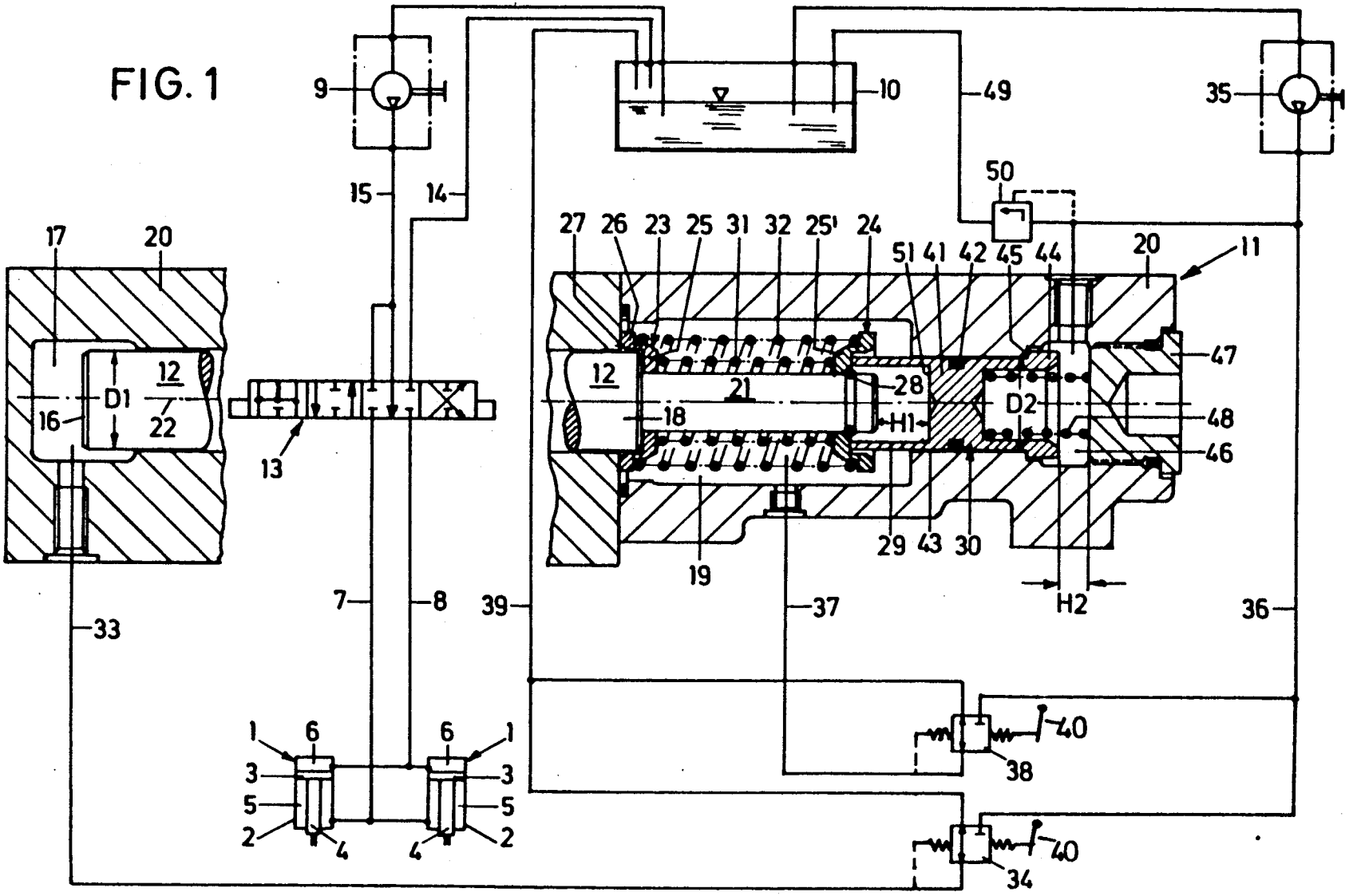
FIG. 1 shows a multiport valve in accordance with this invention.

One or a plurality of hydraulically charged piston-cylinder drives 1 each have a cylinder 2 and a piston 3, guided inside the former in a longitudinally slidable manner. A piston rod 4 is attached to the piston 3 and sealingly extends from one end of the cylinder 2. By means of the drive(s) 1, for example the planing blade of a grader or the bucket of a front loader or the like, are moved in height. The piston rod 4 passes through an annular piston chamber 5 formed between the piston 3 and the associated end of the cylinder 2. A piston chamber 6 is formed on the side facing away from the piston rod 4 between the piston 3 and the associated end of the cylinder 2, the cross section of the piston chamber 6 being greater by the size of the cross section of the piston rod 4 than the cross section of the annular piston chamber 5. Each annular piston chamber 5 and each piston chamber 6 are each connectible via a pressure medium line 7 or 8 with a pump 9, serving as a working pressure fluid source, or a reservoir 10, to which the pump 9 has been connected in turn.

Control of the drives 1 is accomplished via a multiport valve 11, partially only schematically shown. This multiport valve 11 has a piston 12 serving as a valve slide, the central section of which is used for the activation of a valve block 13, which serves for the control of the pressure medium paths between drive 1 and pump 9 or reservoir 10. For this purpose the two pressure medium lines 7, 8 end in the usual way in the valve block 13. Furthermore, a return line 14 leads to the reservoir 10 and a pressure medium supply line 15 from the pump 9 to the valve block 13. In the drawing, a central position of the piston 12 and thus of the corresponding piston slide is shown, in which the pressure medium lines 7 and 8 are closed, i.e. the piston rods 4 of the drives 1 are hydraulically locked in the two possible positions of displacement. If the cylinder 12 is moved to the left in the drawing into a first working position, the pressure medium line 8 is connected to the pump 9 and the pressure medium line 7 to the reservoir 10, so that the corresponding piston chamber 6 is charged with pressure medium, which leads to an outward movement of the piston 3 with the piston rod 4 out of the cylinder 2. In this manner the load carried by the drive 1 is lifted. If, however, the cylinder 12 is moved from the center position shown to the right in the drawing into a second working position, the pressure medium line 7 and thus the respective annular piston chamber 5 is charged with pressure medium, while the respective piston chamber 6 is connected to the reservoir 10 via the line 8 and is thus relieved. This results in a return of the piston rod 4 into the cylinder 2 , thus a lowering of the load such as a planing blade.

The piston 12 ends with its one end (to the left in the drawing) 16 in a first control chamber 17. With its other end 18 it ends in a second control chamber 19. The control chambers 17, 19 are formed altogether in the housing 12, as a rule comprising several parts, of the valve 11. At the end 18 of the piston 12 follows a receiving section 21, tapering with respect to the piston 12, which is of one piece with the piston 12 and extends coaxially to its central longitudinal axis 22.

Two spring support plates 23, 24 are disposed on the receiving section 21. The one support plate 23, facing towards the piston 12, abuts in the central position of the piston 12 shown against the piston 12 with an inner annular section 25, and with an outer flange ring 26 against a stop 27 fixed on the housing, which is formed by a wall delimiting the second control chamber 19. The other spring support plate 24 abuts with an inner annular section 25' against a safety ring 28 on the section 21. Furthermore, the support plate 24 rests with its end facing away from the piston 12 on an annular rim 29 of a restraining piston 30. Two pre-stressed helical pressure springs 31, 32 are located between the two support plates 23, 24. If the piston 12 is displaced towards the left in the drawing in the manner already discussed, the left support plate 23 is supported with its flange ring 26 against the stop 27 fixed on the housing, therefore remains in its initial position. The other support plate 24 is taken along by the safety ring 28, so that both pressure springs 31, 32 are further compressed. If the piston 12 is moved to the right in the drawing, the support plate 24 rests against the annular rim 29 of the restraining piston 30, thus is also arrested, while the support plate 23 is taken along by the piston 12. In this case, too, the two pressure springs 31, 32 are further compressed, i.e. they exert a force on the piston 12 which acts opposite to the displacement movement of the piston 12.

The described actions of the piston 12, serving as a piston slide, take place by a corresponding charging of the first control chamber 17 or the second control chamber 19 with control pressure, the respectively other control chamber 19 or 17 being relieved from pressure. For this purpose the first control chamber 17 is connected via a control line 33 with a manually operable pilot valve 34 which, in turn, is connected via a supply line 36 to a pump 35, serving as control pressure medium source. The second control chamber 19 is connected via a control line 37 with a pilot valve 38, basically correspondingly designed and also manually operable, which is also connected to the supply line 36. Both pilot valves 34, 38 are connected via a return line 39 to the reservoir 10. Of course, both pilot valves 34, 38 may be combined in the usual manner into one valve, in which case only one operating lever 40 need to be provided, which would be pivoted out of a center position in one direction for charging the first control chamber 17 with pressure and pivoted in the other direction for charging the second control chamber 19 with pressure.

The restraining piston 30, sealed by a gasket 42 in its central section 41, is slidingly guided in a cylinder guide 43, which extends coaxially to its axis 22. On its side opposite the second control chamber 19 and its annular rim 29, it has an annular collar 44 extending beyond the cylindrical section 41 which, in the position of rest shown, abuts on a stop 45 fixed on the housing and in this way limits a displacement of the restraining piston 30 in the direction towards the piston 12. This end of the restraining piston 30 is located in a control chamber 46 which is continuously charged via the supply line 36 with the full, i.e. maximum control pressure by the pump 35. The control chamber 46 is closed by means of a locking screw 47, which is supported against a prestressing screw 48 in the form of a helical pressure spring which, in turn, is supported against the restraining piston 30 and pushes it in the direction towards the piston 12, i.e. presses the annular collar 44 against the stop 45. The control chamber 46 furthermore is connected to the reservoir 10 via a return line 49, in which a pressure control valve 50 is located. The diameter D1 of the cylindrical piston 12 is greater than the diameter D2 of the cylindrical section 41 of the restraining piston 30.

The pilot valves 34, 38 are designed as continuously operating pressure control valves, so that the control chambers 17, 19 can be charged optionally and respectively alternately with a different control pressure which, for the described charging of the respective annular piston chamber 5 for lowering the load or for charging the respective annular piston chamber 6 for raising the load, is smaller than the maximum control pressure provided by the pump 35 in the control chamber 46. Although the active surface of the piston 12 with the diameter D1 in the control chamber 17 is greater than the active surface of the restraining piston 30 corresponding to the diameter D2, the latter remains in its holding position shown in the drawing. Thus, if the load is to be lowered through charging of the respective annular piston chamber 5, the pilot valve 34 is activated, because of which the first control chamber 17 is charged with control medium, the pressure of which corresponds to the degree of activation of the operating lever 40 and which therefore only corresponds to a part of the pressure exerted by the maximum control pressure. In this case the piston 12 is displaced in the direction towards the second control chamber 19 and the spring support plate 23 is taken along, while the other spring support plate 24 remains in its position where it abuts against the annular rim 29 of the restraining piston 30. Because this force, acting on the restraining piston 30 from the direction of the control chamber 46 and the prestressed spring 48, is greater than the force exerted on it by the piston 12, the restraining piston 30 remains in its holding position shown and thus forms an abutment for the spring support plate 24. The two pressure springs 31, 32 continue to be compressed until equilibrium between the force acting from the direction of the first control chamber 17 and the counterforce exerted by the pressure springs 31, 32 is achieved. The valve block 13 is controlled corresponding to this displacement of the piston 12 serving as a valve slide, so that the respective annular piston chamber 5 is charged with pressure medium via the line 7. The respective valve chamber 6 is connected to the reservoir 10 via the line 8, the valve block 13 and the return line 14.

If alternately the load is to be lifted, i.e. the respective piston chamber 6 is to be charged, the pilot valve 38 is correspondingly opened so that control medium reaches the second control chamber 19. This also acts over a surface corresponding to the diameter D1 on the piston 12 and displaces it in the direction towards the first control chamber 17, the spring support plate 23 remaining in its position at the stop 27. In contrast thereto the other support plate 24 is taken along by the safety ring 28, by means of which the two pressure springs 31, 32 are again compressed. Again the displacement movement occurs until the already mentioned equilibrium of forces occurs. Because the pressure in the control chamber 46 is greater than that in the second control chamber 19, the restraining piston 30 remains in its holding position. Both pilot valves 34, 38 are connected to the reservoir 10 via the return line 39 when they are in their non-operating position, so that during the displacement of the piston 12 the control fluid not displaced in the respective control chamber 17 or 19 can run off.

If it is intended to place the drives 1 into a so-called floating position, in which the respective piston chamber 6 and the respective annular piston chamber 5 are connected to the reservoir 10, thus are short-circuited, it is necessary to displace the piston 12, which serves as a piston slide, into an extreme position for a corresponding activation of the valve block 13. This extreme position corresponds to a position further displaced towards the right. For this the first control chamber 17 is charged with the full control pressure provided by the pump 35 by completely opening the control valve 34. Because with this control pressure the force acting on the piston 12 in the direction of the restraining piston 30 is greater than the force acting on the latter in the opposite direction from the control chamber 46, the piston 12 is displaced until the receiving section 21 lies against the bottom 51 of the restraining piston 30 facing it. With continued movement the piston 12 then pushes the restraining piston 30 in the direction of the control chamber 46 into a deflected position. In this case the control medium contained therein and being under full, i.e.

maximum control pressure is pushed into the reservoir 10 via the pressure control valve 50. Therefore the restraining piston 30 can partially follow the movement of the piston 12.

The maximally possible stroke H1 of the piston 12 in respect to the restraining piston 30 is predetermined by the distance between the receiving section 21 and the bottom 51 of the restraining piston 30. It is possible to maximally displace the piston 12 by this stroke H1 when the function "lower the load" is selected. The piston can then be additionally displaced by the stroke H2, which is predetermined by the distance between the restraining piston 30 and the locking screw 47. This second stroke H2 therefore can be selected for the function "floating position". It corresponds to the stroke of the restraining piston 30 from the holding position into the deflected position.

The pressure control valve 50 also has the main function of maintaining constant the control pressure supplied by the pump 35. If it is exceeded, the pressure control valve 50 opens and allows the pressure to be relieved in the direction towards the reservoir 10. Maximum control pressure obtains continuously not only in the control chamber 46, but also in the supply line 36 upstream of the pilot valves 34, 28.

We claim:

1. A multiport valve for the control of the working pressure medium paths between a consumer (1) and a working pressure medium source (9) or a tank (10), having a control chamber (17, 19) each disposed on an end (16, 18) each of a valve slide (12), which can be connected with a control pressure source (35), a maximum control pressure being kept constant by means of a pressure control valve (50), having a restraining piston (30) delimiting a second control chamber (19), the side of which facing away from the second control chamber (19) is charged with maximum control pressure via a control chamber (46) connected with the control pressure source (35), the restraining piston (30) being movable between a holding position and a deflected position, having at least one pressure spring (31, 32) disposed in the second control chamber (19) and supported on the valve slide (12) and the restraining piston (30) and at least one pilot valve (34, 38) for setting the control pressure in the control chambers (17, 19), where, starting at a center position in which the pressure medium paths to the consumer (1) are locked and the restraining piston (30) is in the holding position and charged with the maximum control pressure, the valve slide (12) is displaceable against the force of the at least one pressure spring (31, 32) in both directions into each case at least one working position and where, starting from a working position, in which the second control member (19) abutting against the restraining piston (30) is pressure-relieved, the restraining piston (30) is displaceable into the deflected position, in which the valve slide (12) supported by means of at least one pressure spring (31, 32) on the restraining piston (30), is movable by the control pressure charging the first control chamber (17) into a floating position of the consumer (1), in which the working chambers (5, 6) of the consumer (1) are connected with each other, wherein the valve slide (12) in the first control chamber (17) has a greater diameter than the restraining piston (3), said restraining piston having an interior partition wall between opening ends of said restraining piston, said interior partition wall closing communication between said opening ends such that the force in the first control chamber (17) acting on the valve slide (12) in the direction of the restraining piston (30), at least during maximum control pressure, is greater than the force acting in the opposite direction from the control chamber (46) on the restraining piston (30) whereby the maximum pressure in the control chamber (46) is maintained.

2. A multiport valve in accordance with claim 1, wherein the restraining piston (30) is loaded with a pre-stressing spring (48) on its side facing the control chamber (46).

* * * * *